US006744216B2

(12) United States Patent
Saito et al.

(10) Patent No.: US 6,744,216 B2
(45) Date of Patent: Jun. 1, 2004

(54) DISPLAY DEVICE REQUIRING NO SCRAMBLE CIRCUIT

(75) Inventors: Junichi Saito, Miyagi-ken (JP); Tatsumi Fujiyoshi, Miyagi-ken (JP); Yukimitsu Yamada, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/206,728

(22) Filed: Jul. 25, 2002

(65) Prior Publication Data

US 2003/0057857 A1 Mar. 27, 2003

(30) Foreign Application Priority Data

Jul. 27, 2001 (JP) ..... 2001-228653

(51) Int. Cl.[7] ..... G09G 3/10; G09G 17/00
(52) U.S. Cl. ..... 315/169.3; 345/204
(58) Field of Search ..... 315/169.1, 169.2, 315/169.3, 169.4; 345/98, 100, 204, 87, 80, 206, 698

(56) References Cited

U.S. PATENT DOCUMENTS 6,266,039 B1 * 7/2001 Aoki ..... 345/94
6,331,845 B1 * 12/2001 Kitajima et al. ..... 345/88
6,339,411 B2 1/2002 Miyazaki et al. ..... 345/1.1
6,448,953 B1 * 9/2002 Murade ..... 345/98
6,518,946 B2 * 2/2003 Ode et al. ..... 345/98
6,528,822 B2 * 3/2003 Murade ..... 257/72
2002/0030657 A1 * 3/2002 Kono et al. ..... 345/92

* cited by examiner

*Primary Examiner*—Haissa Philogene
*Assistant Examiner*—Minh D A
(74) *Attorney, Agent, or Firm*—Beyer Weaver & Thomas

(57) ABSTRACT

A display device includes, on a first substrate of a pair of substrates, data lines and scanning lines crossing in the form of a matrix. Among the data lines, a first group of data lines lead to a first side of the first substrate, and a second group of data lines, other than the first group of data lines, lead to a second side positioned opposite to the first side. The display device includes a display screen in which the surface of the one substrate is divided into dots by the data lines and the scanning lines and each set of a predetermined number of adjacent dots constitutes each pixel. All data lines which are connected to the predetermined number of adjacent dots constituting the pixel in the display screen lead to a single side among the sides of the first substrate.

10 Claims, 18 Drawing Sheets

DISPLAY DEVICE REQUIRING NO SCRAMBLE CIRCUIT

BACKGROUND OF THE INVENTION

1. Field of the Invention

The present invention relates to display devices, and in particular, to a method for arranging column and row drive lines in a display screen and a method for driving the lines.

2. Description of the Related Art

FIGS. 15A and 15B show the structure of a liquid crystal panel (display device) of the related art. Driving circuits for the liquid crystal panel are typically large in physical size and may require modifications so as to avoid extending the overall physical size of the liquid crystal panel. Thus, to realize a high-definition and small liquid crystal panel, as shown in FIGS. 15A and 15B, the driving circuits for the data lines are divided into upper driving circuits 101*d* and lower driving circuits 101*e*, disposed on two opposite sides, namely, the upper and lower sides of the display screen 101*a*.

FIG. 16 is an enlarged illustration of portion B of the display screen 101*a* shown in FIG. 15A. A first group of alternate ones of the data lines Y1 to Y480 in the display screen 101*a* are routed to the upper side of the display screen 101*a*. The remainder (i.e., the second group of alternate ones of the data lines Y1 to Y480) are routed to the lower side of the display screen 101*a*. Hence, data lines leading to the upper side are connected to the upper driving circuits 101*d*, and data lines leading to the lower side are connected to the lower driving circuits 101*e*. Both driving circuits 101*d* and 101*e* are disposed on a single wiring plate P101 and are connected to the display screen 101*a* by the wiring plate P101.

By disposing the data lines Y1 to Y480 to lead as shown in the configuration in FIG. 16, dot inversion can be realized. The polarities of drive voltages applied to liquid crystal displays are typically reversed many times per second to prevent any deterioration of image quality resulting from dc stress. Dot inversion, which is also known as spatial dot inversion, refers to the technique whereby the polarities of driving voltages applied to adjacent dots in the display screen 101*a* are inverted. By using this technique, spatial frequency can be increased and picture quality having minimized flickering can be obtained. The dot inversion can be realized, for example, by using a driving voltage output from the upper driving circuit 101*d* as a positive polarity, using a driving voltage output from the lower driving circuit 101*e* as a negative polarity, and performing polarity inversion for each line or each field. This operation is made possible by adding a line-inverting driving circuit to a one-sided driving circuit.

FIG. 17 is a block diagram showing the detailed structure of a display device of the related art. This display device includes a display screen 101*a*, an upper driving circuit 101*d*, a lower driving circuit 101*e*, and a scramble circuit 101*g*. The upper driving circuit 101*d* includes a digital-to-analog (D/A) conversion circuit SHU12 for providing analog output signals to pixels Ga1 and Ga2 of the display screen 101*a*, a D/A conversion circuit SHU34 for providing analog output signals to pixels Ga3 and Ga4 of the display screen 101*a*, a D/A conversion circuit SHU56 for providing analog output signals to pixels Ga5 and Ga6, etc. The lower driving circuit 101*e* includes a D/A conversion circuit SHD12 for providing analog output signals to pixels Ga1 and Ga2 of the display screen 101*a*, a D/A conversion circuit SHD34 for providing analog output signals to pixels Ga3 and Ga4 of the display screen 101*a*, a D/A conversion circuit SHD56 for providing analog output signals to pixels Ga5 and Ga6, etc. The display screen 101*a* in FIG. 17 illustrates the pixels Ga1, Ga2, Ga3, etc., for only one line, and only data lines connected to dots constituting these pixels. Other data lines and pixel lines are omitted from the illustration for clarity purposes.

In order that the display screen 101*a* of the liquid crystal panel may show images in their natural colors, a scramble circuit 101*g* is required. Such a circuit changes the order of display data to be sent to the upper driving circuit 101*d* and the lower driving circuit 101*e* to correspond to the arrangement of color filters in the display screen 101*a*. Separate sets of bus lines are required to send display data from the scramble circuit 101*g* to the upper driving circuit 101*d*, and from the scramble circuit 101*g* to the lower driving circuit 101*e*.

FIG. 18 is a timing chart for the display device of the related art. The chart shows the relationships among input data RD, GD, and BD for the scramble circuit 101*g*, display data UA, UB, and UC which are received by the upper driving circuit 101*d* after being transmitted from the scramble circuit 101*g*, and display data DA, DB, and DC which are received by the lower driving circuit 101*e* after being transmitted from the scramble circuit 101*g*. The scramble circuit 101*g* rearranges the order of the input data RD, GD, and BD to an order corresponding to the arrangement of color filters in the display screen 101*a*.

To display an image properly on a display screen of a liquid display panel, i.e., so that the image natural colors are shown properly, the order of display data to be sent to driving circuits on two opposite sides of the display screen must be rearranged to the order corresponding to the arrangement of color filters in the display screen. To accomplish this, separate sets of display-data-bus lines must be formed on each of the two sides (e.g., an upper side and a lower side). This requires wiring areas for the bus lines on both sides, thus hindering size reduction of the display device.

In addition, since a scramble circuit generally includes logic circuits, logic circuits for the bus lines are required on both sides of the display screen. Furthermore, integrated circuits including scramble circuits of the above type require output pins for the bus lines on both sides of the display screen. This not only hinders reduction in the size of the display device, but also increases the display device cost.

Also, during inspection of the liquid crystal panel to diagnose problems found in a displayed picture, a portion causing the problem must be specified. Thus, in order to pinpoint the problem to one of the two sets of data lines leading to both sides of the display screen, driving of one set of data lines may be stopped.

In a structure in which data lines leading from a scramble circuit are connected in an alternating fashion to one of two sides of a display screen, as in the related art, when driving of data lines on one side is stopped, the data output from the driving circuits differs, depending on the which of the two driving circuits is involved. For example, if driving of data lines to an upper side driving circuit is stopped, black display data are output instead of, for example, a normally white liquid crystal panel. When a driving circuit on the lower side of the display screen is stopped, a stripe state occurs in which G, R, B, G, R, B, . . . are displayed on every other line. Accordingly, it is difficult to determine which side has a problem. Even if the side having the problem is determined, it is difficult to further localize the problem. For example, it is difficult to determine which data line from the side has a problem.

SUMMARY OF THE INVENTION

The present invention is made in view of the above-described problems, and it is an object of the present invention to provide a small, inexpensive display device which doesn't require a scramble circuit for scrambling display data to be sent to driving circuits on two sides of the display screen of the display device, and which displays natural color pictures.

It is another object of the present invention to provide a small, inexpensive display device that includes a reduced number of display-data-bus lines for sending display data to driving circuits.

It is another object of the present invention to provide a display device in which, when a displayed picture has a problem, a portion causing the problem can easily be identified.

The present invention provides a display device including a pair of substrates, with electrooptical material provided therebetween, and a plurality of data lines and a plurality of scanning lines on a first substrate of the pair of substrates. The plurality of data lines and the plurality of scanning lines cross in the form of a matrix. The plurality of data lines include two mutually exclusive groups of data lines, a first group leading to a first side of the first substrate, and a second group of data lines leading to a second side of the first substrate, the first and second sides positioned so as to oppose each other. The display device includes a display screen in which the surface of the first substrate is divided into a plurality of dots by the plurality of data lines and the plurality of scanning lines. Each set of a predetermined number of adjacent dots constitutes one pixel. All data lines from the adjacent dots constituting one pixel lead to a single side of the first substrate, the particular side determined by the pixel location.

According to the above structure, data lines connected to dots constituting one pixel can be connected to a single driving circuit because they lead to a single side of a display screen. Therefore, the data lines can be driven by the single driving circuit. This arrangement eliminates the need for a scramble circuit to sort the order of display data to be input to driving circuits on two sides of the display screen. Hence, a small, inexpensive display device that can display natural color pictures can be provided.

Moreover, since a single driving circuit is provided, it is not necessary to provide separate sets of display-data-bus lines for connecting to driving circuits located on opposite sides of the display screen. Thus, the width of each bus line can be reduced, and a small, inexpensive display device can be provided.

Also, in testing of a displayed picture with a problem, the location of data lines on one side allows white color to be displayed by normal pixels. Hence, the display device can identify the location of the problem by reference to the non-white pixels.

Preferably, a plurality of pixels arranged along the scanning lines on the first substrate of the display screen are classified for each set of an odd number of pixels into a first group and a second group in the arranged order, the first group of data lines are connected to dots constituting the first group of pixels, and the second group of data lines are connected to dots constituting the second group of pixels.

Preferably, a plurality of pixels arranged along the scanning lines on the first substrate included in the display screen are classified for each set of an even number of pixels into a first group and a second group in the arranged order, the first group of data lines are connected to dots constituting the first group of pixels, and the second group of data lines are connected to dots constituting the second group of pixels.

The display device may include a first driving circuit which supplies the first group of data lines with driving signals for driving the dots, and a second driving circuit which supplies the second group of data lines with driving signals for driving the dots. Input data may be supplied to the first driving circuit and the second driving circuit through common lines.

The above structure is realized such that the driving circuit on one side is connected to different wiring plates on the one side, the wiring plates are connected to a further wiring plate, and display data lines are connected in parallel on the further wiring plate. This type of structure is preferable in that space for wiring can be reduced.

The display device may include a first driving circuit which supplies the first group of data lines with driving signals for driving the dots, and a second driving circuit which supplies the second group of data lines with driving signals for driving the dots. The first driving circuit may supply the first group of data lines with driving signals having polarities inverted between two adjacent data lines, and the second driving signal may supply the second group of data lines with driving signals which have polarities inverted between two adjacent data lines and which have inverse polarities compared with the driving signals supplied to the first group of data lines.

According to the above structure, the need for a scramble circuit is eliminated, and dot inversion is realized.

The display device may include a first driving circuit which supplies the first group of data lines with driving signals for driving the dots, and a second driving circuit which supplies the second group of data lines with driving signals for driving the dots. The first driving circuit may supply the first group of data lines with driving signals having polarities inverted between two adjacent data lines, and the second driving signal may supply the second group of data lines with driving signals which have polarities inverted between two adjacent data lines and which have identical polarities compared with the driving signals supplied to the first group of data lines.

According to the above structure, the need for a scramble circuit is eliminated, and dot inversion is realized.

DESCRIPTION OF THE PREFERRED EMBODIMENTS

Figure 1:
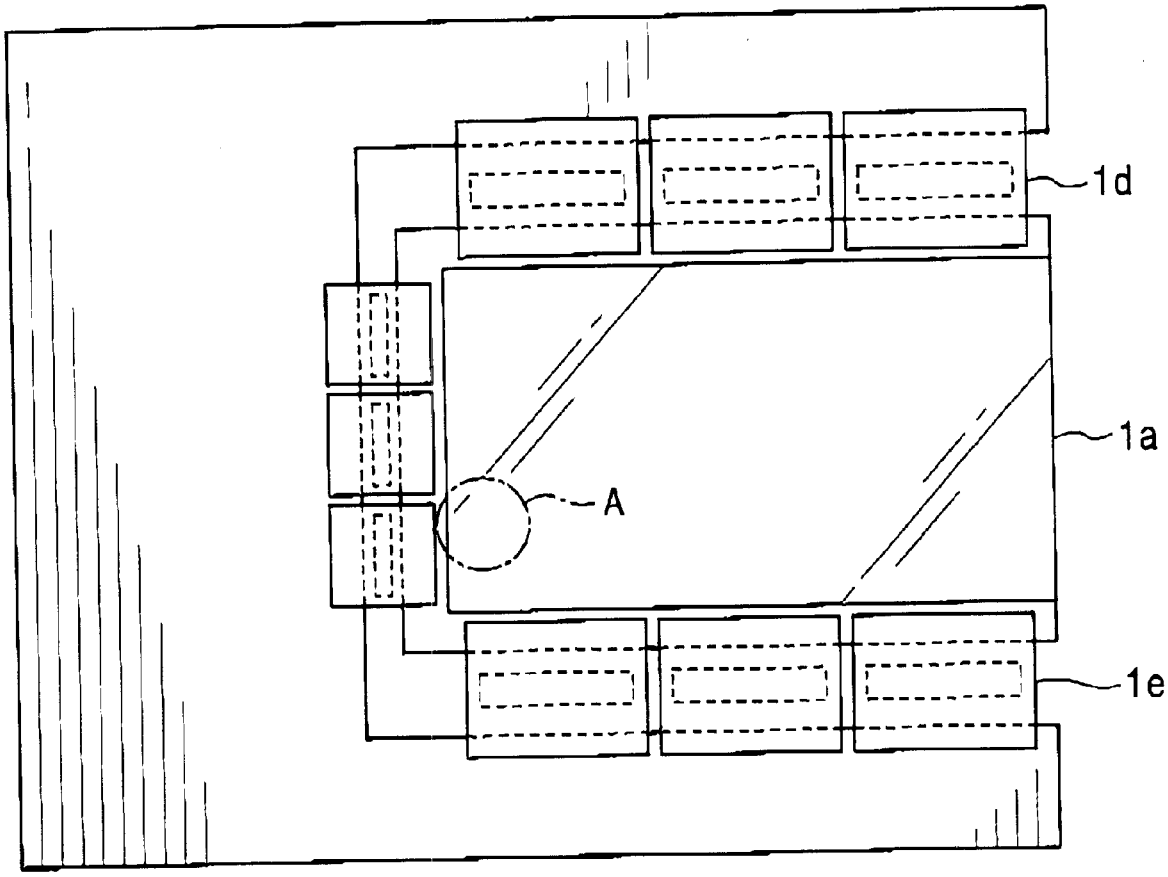
FIG. 1 is an illustration of the overall structure of a display device according to a first embodiment of the present invention.

FIG. 1 shows the overall structure of a display device according to a first embodiment of the present invention. This display device includes a display screen (also referred to hereinafter as display part) 1*a*. The display screen *a* has a pair of glass substrates, with liquid crystal provided therebetween. On one of the glass substrates, a plurality of data lines and a plurality of scanning lines are formed. The data lines and the scanning lines cross one another. Upper driving circuits 1*d* are disposed on the upper side of the display screen 1*a*, and lower driving circuits 1*e* are disposed on the lower side of the display screen 1*a*.

Figure 2:
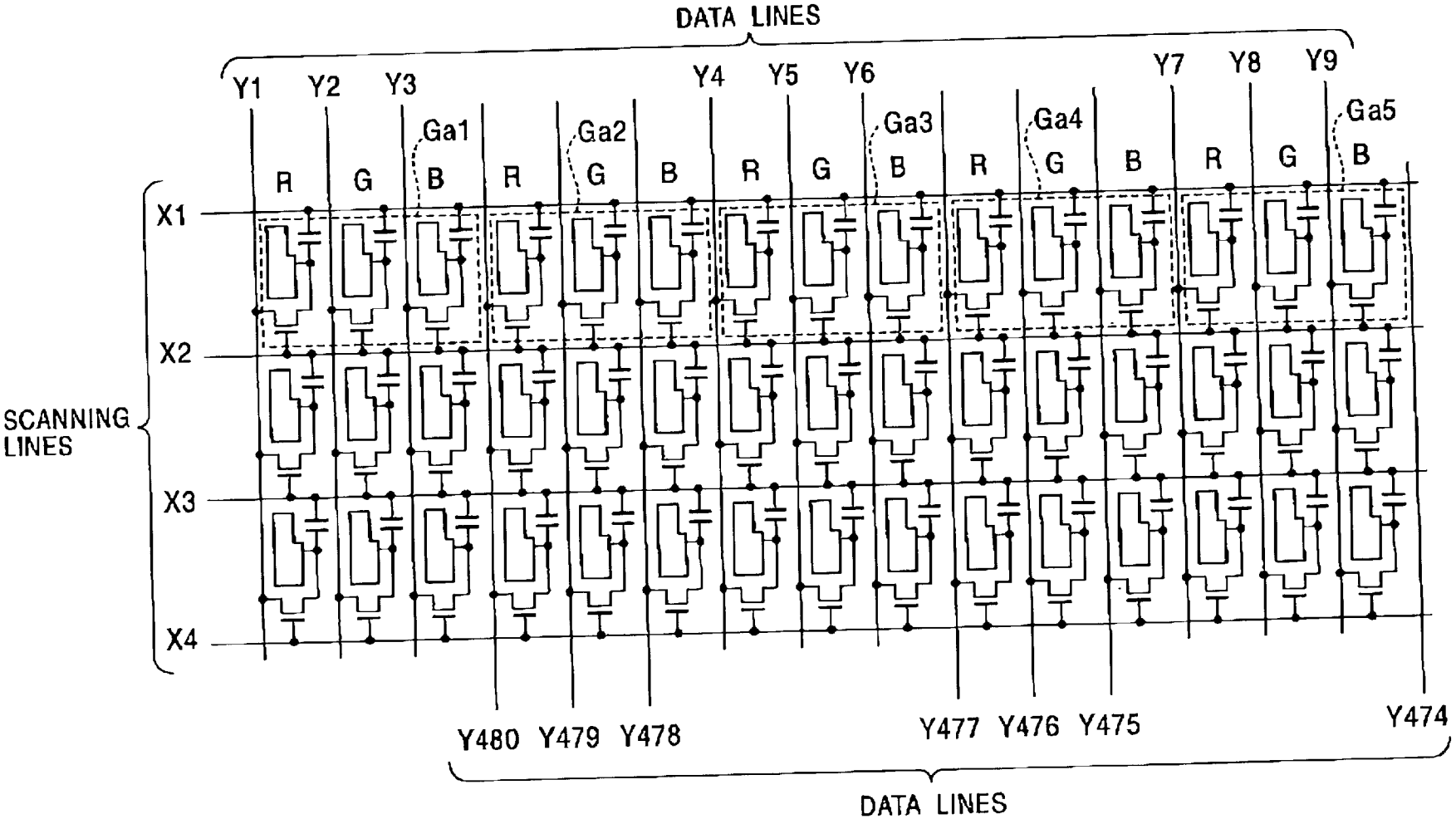
FIG. 2 is a circuit diagram in which the display screen 1*a* in FIG. 1 is shown enlarged.

FIG. 2 is an enlarged illustration of portion A of the display screen 1*a* shown in FIG. 1. On one of the pair of glass substrates constituting the display screen 1*a*, a plurality of data lines Y1, Y2, Y3, etc., and a plurality of scanning lines X1, X2, X3, etc., are formed. The data lines Y1, Y2, Y3, etc., and the scanning lines X1, X2, X3, etc., cross one another. Dots are formed in sections defined by the data lines Y1, Y2, Y3, etc., and the scanning lines X1, X2, X3, etc. Each of the dots is provided with one of three filters corresponding to three primary colors, red (R), green (G), and blue (B).

On dots arranged along the scanning lines X1, X2, X3, etc., three primary color filters are sequentially disposed in the order of R, G, B, R, G, B, etc. Each set of three adjacent dots, that is, each set of three primary color dots constitutes each pixel. For example, in a region provided between the scanning lines X1 and X2, pixels Ga1, Ga2, Ga3, etc., are disposed.

The data lines Y1, Y2, Y3, etc., and the scanning lines X1, X2, X3, etc., are connected to dots constituting the pixels Ga1, Ga2, Ga3, etc. The data lines Y1, Y2, and Y3 that are respectively connected to three dots constituting the pixel Ga1 lead to the upper side of the display screen 1*a*. Data lines Y480, Y479, and Y478 that are respectively connected to three dots constituting the pixel Ga2, which is adjacent to the pixel Ga1, lead to the lower side of the display screen 1*a*. Thus, the data lines Y1, Y2, Y3, etc., grouped into groups of three with one group per pixel, are arranged so that each group leads to a destination which is either the upper or lower side, the side alternating from the destination side for lines from the adjacent pixels along the scan line. The data lines leading to the upper side are connected to the upper driving circuit 1*d*, and the data lines leading to the lower side are connected to the lower driving circuits 1*e* illustrated in FIG. 1.

Figure 3:
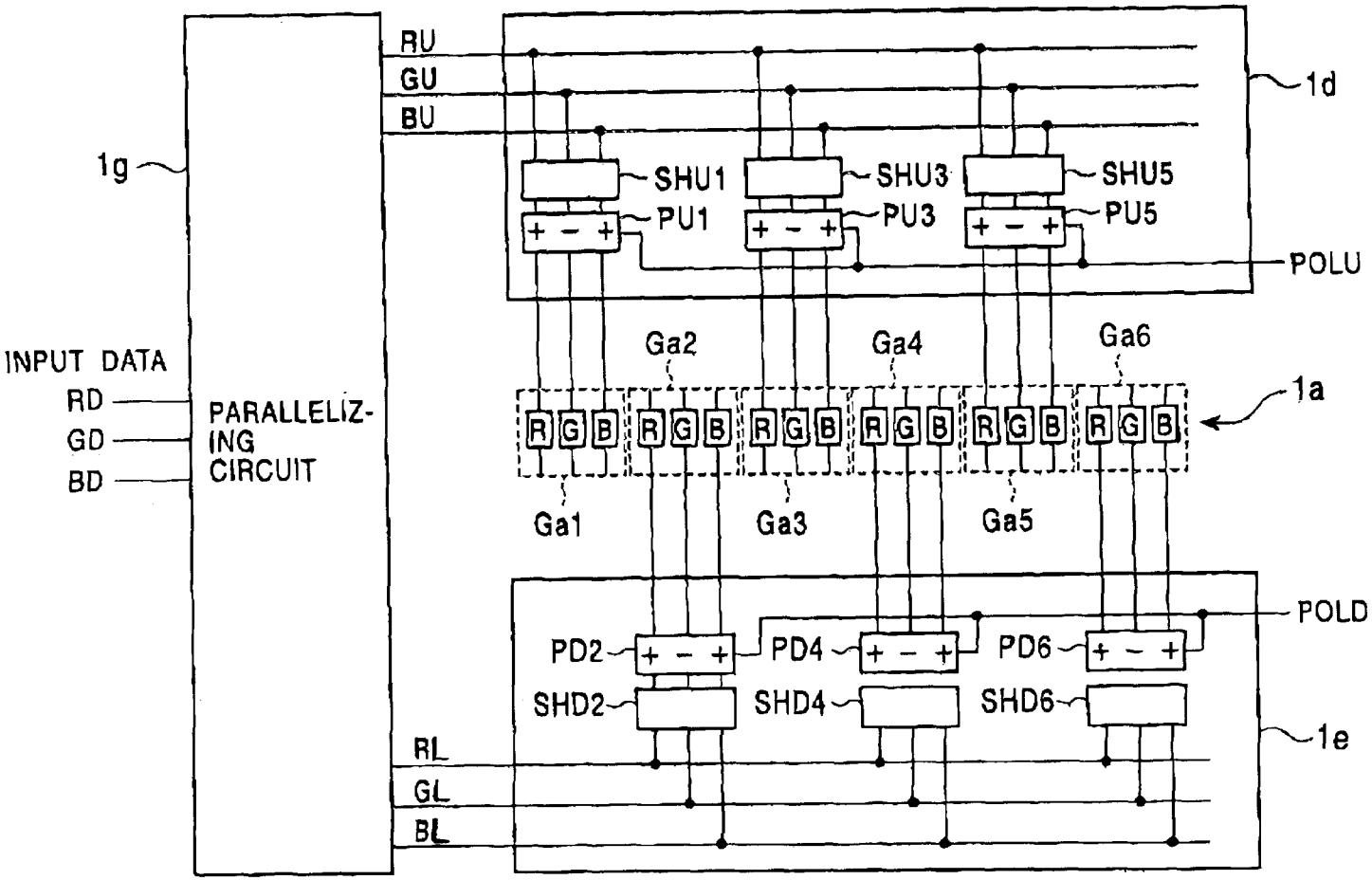
FIG. 3 is a detailed block diagram showing the display device according to the first embodiment of the present invention.

FIG. 3 is a detailed block diagram showing the display device according to the first embodiment. This display device includes the display screen 1*a*, the upper driving circuit 1*d*, the lower driving circuit 1*e*, and a parallelizing circuit 1*g*. In the display screen 1*a* in FIG. 3, the pixels Ga1, Ga2, Ga3, etc., for one line, and the data lines connected to dots constituting the pixels Ga1, Ga2, Ga3, etc., are only shown. The other pixels and lines are omitted from the illustration for clarity purposes.

The parallelizing circuit 1*g* receives input data RD, GD, and BD, sends display data RU, GU, and BU to the upper driving circuit 1*d*, and sends display data RL, GL, and BL to the lower driving circuit 1*e*. The parallelizing circuit 1*g* divides the input data RD, GD, and BD into two data, and doubles the period of the data. The parallelizing circuit 1*g* outputs the doubled data as the display data RU, GU, and BU and as the display data RL, GL, and BL.

In the upper driving circuit 1*d*, digital-to-analog (D/A) conversion circuits SHU1, SHU3, SHU5, etc., and polarity control circuits PU1, PU3, PUS, etc., are provided so as to correspond to the pixels Ga1, Ga3, Ga5 in the display screen 1*a*. A polarity control signal POLU is input to the polarity control circuits PU1, PU3, PU5, etc.

In accordance with the polarity control signal POLU, each of the polarity control circuits PU1, PU3, PU5, etc., switches the polarity of a driving voltage applied to the dots. For example, when the polarity control signal POLU is at a high level, each of the polarity control circuits PU1, PU3, PU5, etc., applies driving voltages having positive, negative, and positive polarities (+, −, +) to the R, G, and B dots. When the polarity control signal POLU is in a low level, each of the polarity control circuits PU1, PU3, PU5, etc., applies driving voltages having negative, positive, and negative polarities to the R, G, and B dots.

In the lower driving circuit 1*e*, D/A conversion circuits SHD2, SHD4, SHD6, etc., and polarity control circuits PD2, PD4, PD6, etc., are provided so as to correspond to the pixels Ga2, Ga4, Ga6, etc. A polarity control signal POLD is input to the polarity control circuits PD2, PD4, PD6, etc.

Each of the polarity control circuits PD2, PD4, PD6, etc., switches the polarities of driving voltages applied to the dots. For example, when the polarity control signal POLD is in a high level, each of the polarity control circuits PD2, PD4, PD6, etc., applies driving voltages having positive, negative, and positive polarities to the R, G, and B dots. When the polarity control signal POLD is in a low level, each of the polarity control circuits PD2, PD4, PD6, etc., applies driving voltages having negative, positive, and negative polarities to the R, G, and B dots.

Figure 4:
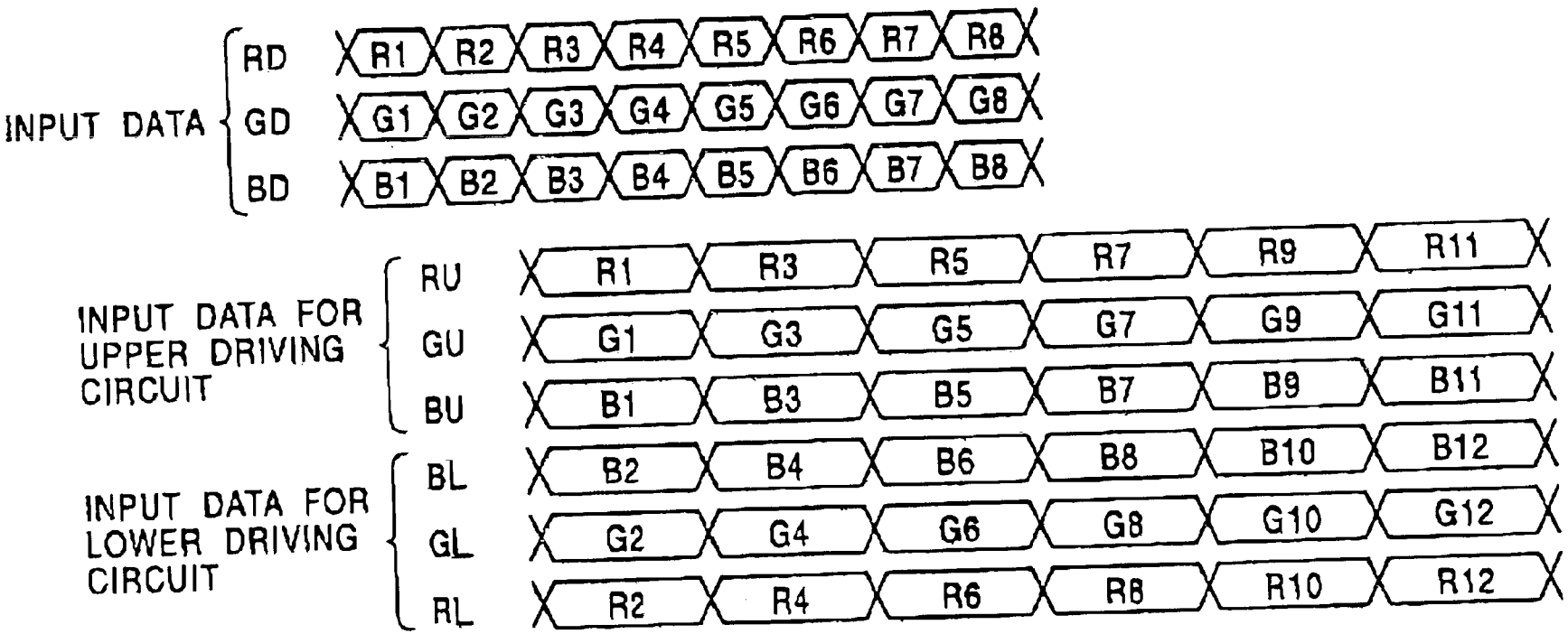
FIG. 4 is a timing chart showing a relationship between data received by a parallelizing circuit 1*g* and display data transmitted from the parallelizing circuit 1*g;*

FIG. 4 is a timing chart showing relationships among the data RD, GD, and BD received by the parallelizing circuit 1*g*, the display data RU, GU, and BU received by the upper driving circuit 1*d*, and the display data RL, CL, and BL that are received by the lower driving circuit 1*e* after transmission from the parallelizing circuit 1*g*. As noted earlier, the parallelizing circuit 1g divides the input data RD, GD, and BD into two data, and doubles the period of the data. The parallelizing circuit 1g sends the doubled data as the display data RU, GU, and BU and as the display data RL, GL, and BL.

The upper driving circuit 1d and the lower driving circuit 1e capture the output display data sent by the parallelizing circuit, and send the captured display data to each data line in the display screen 1a in accordance with a write-control signal (not shown). Based on the captured display data, the upper driving circuit 1d and the lower driving circuit 1e send to each data line in the display screen 1a, a driving signal that is positive or negative. That is, the driving signal is positive or negative with reference to predetermined voltage treated as a zero reference level. The polarity of the driving signal is controlled by the polarity control signals POLU and POLD.

For example, on the top line of pixels, the polarity control signal POLU is set to the high level, and the polarity control signal POLD is set to the low level. This alternately applies positive and negative driving voltages to the dots on the top line. On the next line, the polarity control signals POLU and POLD are inverted, and on the subsequent line, the polarity control signals POLU and POLD are inverted again. By repeatedly performing the inversion for each line, dot inversion can be realized.

Figure 5A:
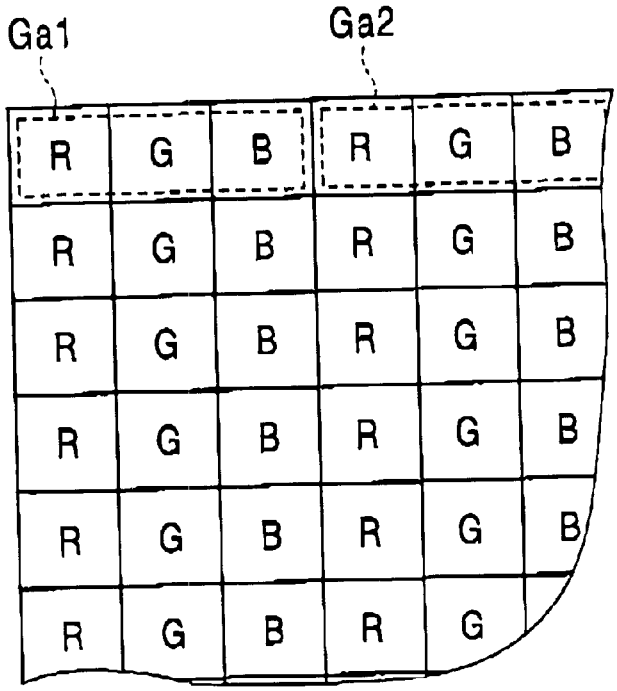
FIGS. 5A and 5B are illustrations of dot inversion.
Figure 5B:
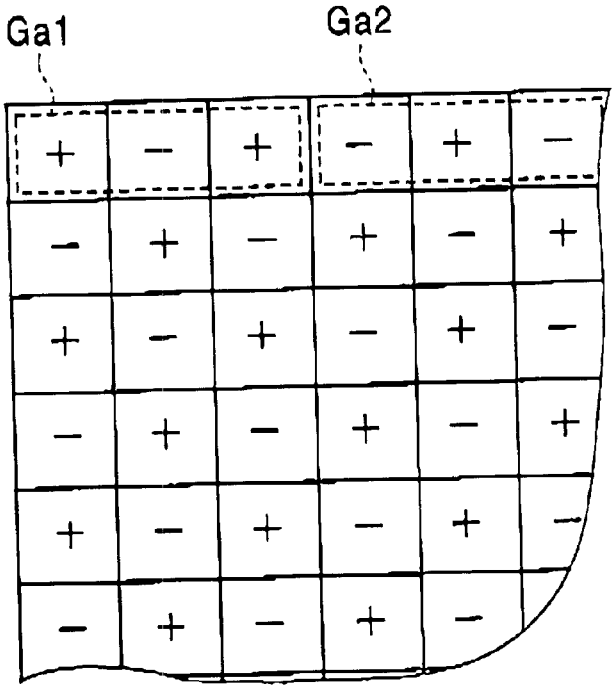

The dot inversion is performed in order to prevent the characteristics of liquid crystal or the like from deteriorating. Dot inversion here includes spatial dot inversion (i.e., inverting the driving voltages for adjacent dots on a scan line and for succeeding lines) and time domain dot inversion (i.e., inverting the driving voltages for a dot from one field or frame to a next one). As FIGS. 5A and 5B show, the dot inversion means that the polarities of driving signals applied to adjacent dots are inverted. As a result, the spatial frequency is increased and picture quality is improved by minimizing flickering.

For a specific example, when interlaced scanning is used as the display method, the polarities of driving signals may be inverted for each field. Dot inversion in the time domain may also be realized by inverting the polarities of driving signals for each frame, for example in non-interlaced scanning.

As described above, by arranging the data lines for each pixel (three dots) so that they alternately lead to the upper and lower sides of the display screen 1a, the need for a conventionally required scramble circuit for input data sorting is eliminated, thus enabling price and size reduction of a display device.

Also, for example, when the display device is configured so that upper driving circuit 1d transmits driving signals having the polarities represented by (R, G, B)=(+, −, +), and the lower driving circuit 1e sends driving signals having the polarities represented by (R, G, B)=(−, +, −), and inverting the polarities of driving signals for each line, the need for the scramble circuit is eliminated and the dot inversion can also be realized.

In the first embodiment, an arrangement has been described in which the data lines alternately lead for each pixel (three dots) to the upper and lower sides of the display screen 1a so as to be connected to the upper driving circuit 1d and the lower driving circuit 1e. However, the example is illustrative and not intended to be limiting. For example, the data lines may lead for each set of three pixels or for each set of five pixels and so on. In general, each set of an odd number of pixels can be used without departing from the spirit or scope of the embodiment of the present invention.

Figure 6:
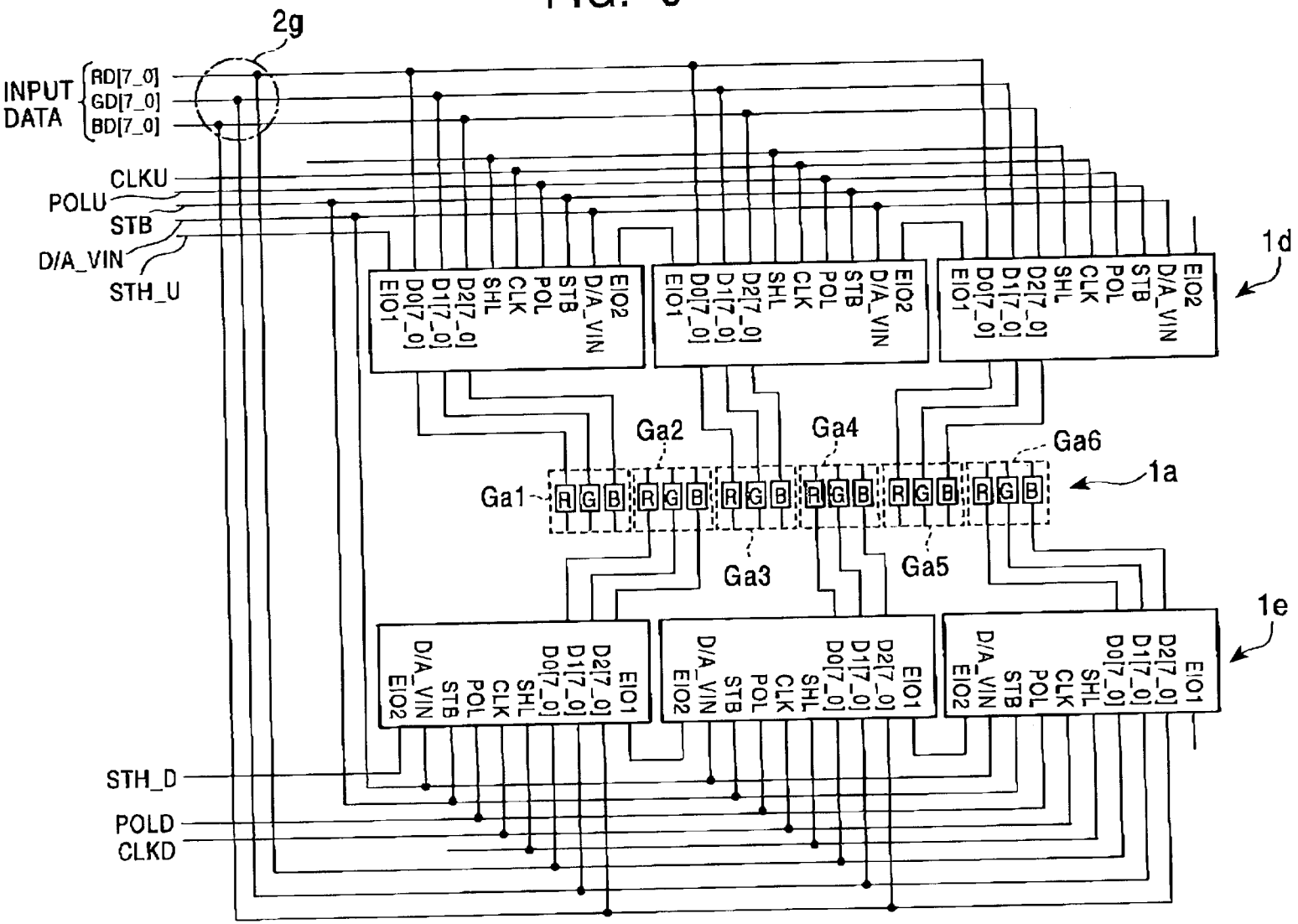
FIG. 6 is a detailed block diagram showing a display device according to a second embodiment of the present invention.

FIG. 6 is a detailed block diagram showing a display device according to a second embodiment of the present invention. This display device includes a display screen 1a, upper driving circuits 1d, and lower driving circuits 1e. In the display screen 1a in FIG. 6, the pixels Ga1, Ga2, Ga3, etc., for one line, and the data lines connected to dots constituting the pixels Ga1, Ga2, Ga3, etc., are only shown. The other pixels and lines are omitted from the illustration for clarity purposes.

In a manner similar to the first embodiment, the data lines in the second embodiment alternately lead for each pixel to one or the other of the upper and lower sides of the display screen 1a. The data lines leading to the upper side are connected to the upper driving circuits 1d, and the data lines leading to the lower side are connected to the lower driving circuits 1e. Bus lines through which input data RD, GD, and BD are sent are branched in a parallel connection part 2g and are received by the upper driving circuits 1d and the lower driving circuits 1e.

A clock CLKU, a start pulse STH_U, and a polarity control signal POLU are also received by the upper driving circuits 1d. Clocks CLKD, a start pulse STH_D, and a polarity control signal POLD are also received by the lower driving circuits 1e.

Figure 7:
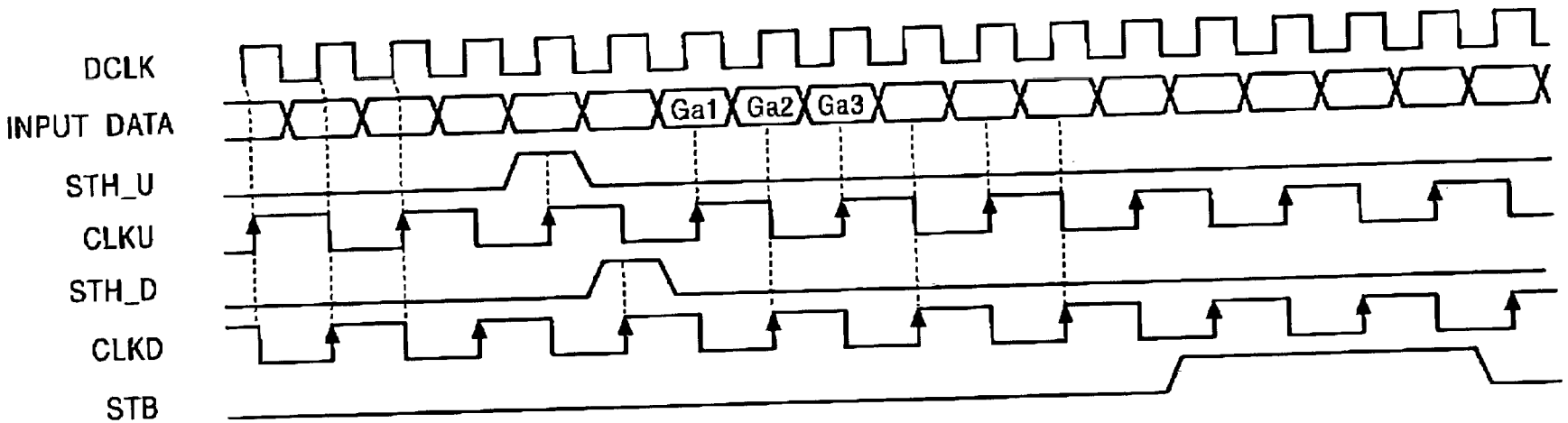
FIG. 7 is a timing chart showing the operation of the display device according to the second embodiment of the present invention.

FIG. 7 is a timing chart showing the operation of the display device according to the second embodiment. The data RD, GD, and BD are received by the upper driving circuits 1d and the lower driving circuits 1e with timing that is synchronized with dot clocks DCLK.

Clocks CLKU supplied to the upper driving circuits 1d are such that the dot clocks DCLK are frequency-divided. For example, the period of CLKU is doubled in comparison to the period of DCLK. The clocks CLKD supplied to the lower driving circuits 1e are such that the clocks CLKU are inverted.

When the start pulse STH_U is received by the upper driving circuits 1d in synchronization with the clocks CLKU, the upper driving circuits 1d synchronize with a rise of the clocks CLKU that follow the start pulse STH_U and capture the data RD, GD, and BD received by input terminals D0, D1, and D2.

The start pulse STH_D is received by the lower driving circuits 1e in synchronization with a rise of the clocks CLKD which are delayed for a half period from the clocks CLKD. Then, the lower driving circuits 1e synchronize with the rise of the clocks CLKD and thus capture the data RD, GD, and BD sent to input terminals D0, D1, and D2.

In other words, the same data are received by the upper driving circuits 1d and the lower driving circuits 1e. The upper driving circuits 1d capture the input data at a rise of the clocks CLKU, while the lower driving circuits 1e capture the input data at a fall of the clocks CLKD. Accordingly, the input data are alternately captured by the upper driving circuits 1d and the lower driving circuits 1e and are displayed by pixels in correct positions.

According to the above structure, the need for the parallelizing circuit 1g is eliminated, and bus lines for sending the input data to the upper driving circuits 1d and bus lines for sending the input data to the upper driving circuits 1d can be formed as common bus lines, so that an inexpensive and small display device can be provided.

Figure 8A:
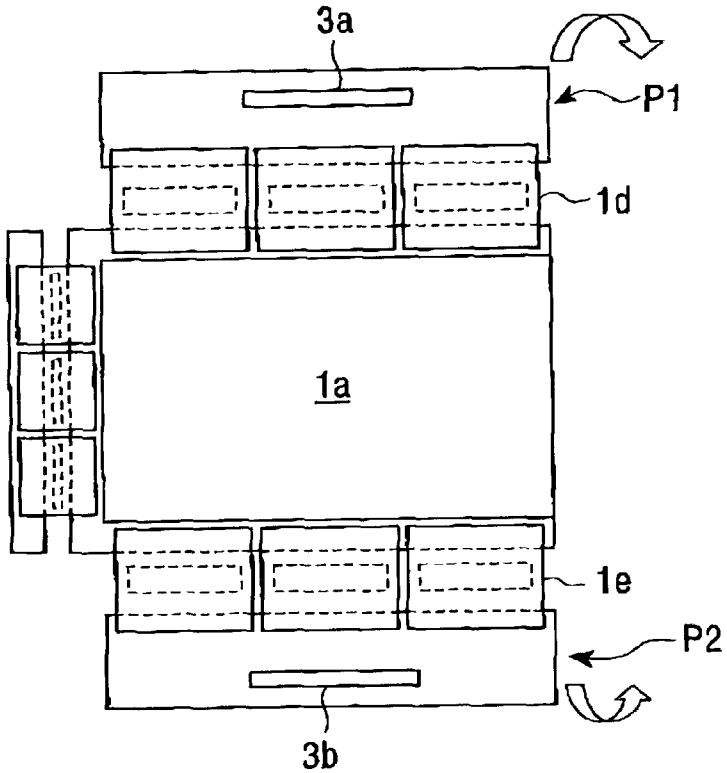
FIGS. 8A, 8B, and 8C are illustrations of a display device according to a third embodiment of the present invention.
Figure 8B:
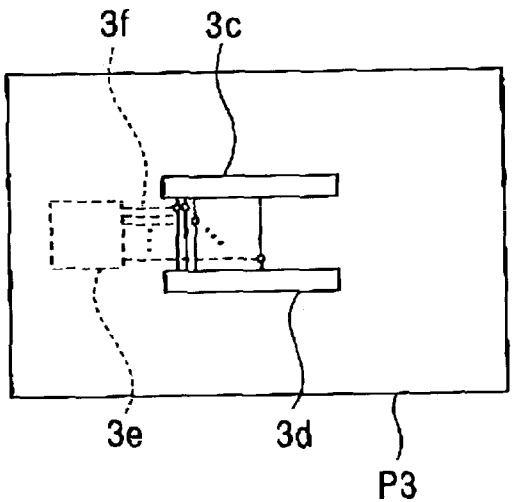
Figure 8C:
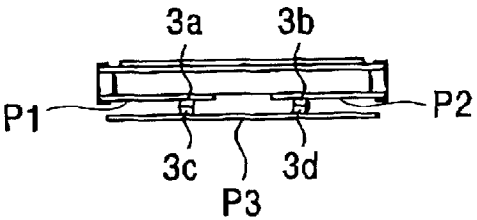

FIGS. 8A and 8B show the structure of a display device according to a third embodiment of the present invention. FIG. 8A shows that a display screen 1a, upper driving circuits 1d, lower driving circuits 1e, and wiring plates P1 and P2 are connected to one another. FIG. 8B shows a single wiring plate P3. FIG. 8C shows that the wiring plates P1 and P2 are connected to the wiring plate P3.

For each pixel, the upper driving circuits 1*d* and the lower driving circuits 1*e* are connected to data lines leading to two sides (the upper side and the lower side) of the display screen 1*a*. Data to be input to the upper driving circuits 1*d* and the lower driving circuits 1*e* are input through the wiring plates P1, P2, and P3.

The input terminals D0, D1, and D2 of the upper driving circuits 1*d* are connected to the wiring plate P1, and the input terminals D0, D1, and D2 of the lower driving circuits 1*e* are connected to the wiring plate P2. The wiring plates P1 and P2 are connected to the other wiring plate P3. The wiring plate P3 is configured so that bus lines for sending the input data branch off in one direction to the upper driving circuits 1*d* and a second direction to the lower driving circuits 1*e*.

The wiring plates P1 and P2 include connectors 3*a* and 3*b*, respectively, and the wiring plate P3 includes connectors 3*c* and 3*d*, respectively corresponding to the connectors 3*a* and 3*b*. By connecting mutually opposed connector pins of the connectors 3*c* and 3*d*, the parallel connection part 2*g* shown in FIG. 6 can be formed. By connecting the mutually opposed connector pins, the bus lines are connected in parallel, and lead to the back side of the wiring plate P3 through a throughhole. The bus lines leading to the back side are connected to a logic circuit 3*e*.

In this structure, when the display device has a defect, by dismounting the wiring plate P1 or P2 from the wiring plate P3, it is possible to determine which of the upper side and the lower side is the source of the problem. In other words, an easily executed operation of disconnecting the connector makes it possible to determine the cause of the defect. This diagnostic determination can be made in the configuration where the data lines are connected for each pixel (three dots) to the upper or lower side of the display screen 1*a*.

By way of example, when the upper driving circuits 1*d* are controlled to output black display data, and the lower driving circuits 1*e* are controlled to stop, white lines are displayed on every other line. At this time, the white lines indicate the dots connected to the data lines from the side controlled to stop. Thus, if the white lines are abnormally displayed, it can be found that the lower side has a problem. If black lines are abnormally displayed, it can be found that the upper side has a problem. Also, by counting the number of the white lines or the black lines, a portion causing the problem can easily be specified. The white lines or the black lines correspond to sets of three data lines. Thus, it is only necessary to count a reduced number of white or black lines, compared with the related art. Further, the absence of the different colors for each line in the diagnostic makes identification of the defective portion easier.

In addition, when the display screen 1*a*, the upper driving circuits 1*d*, or the lower driving circuits 1*e* have a defect, it is only required that the wiring plate P1 or P2 be replaced or repaired. Thus, since such repairs don't require repair or replacement of the wiring plate P3 which includes the complex and expensive logic circuit 3*e*, the repair cost can be reduced.

Furthermore, in the case of changing the display function, etc., by replacing only the wiring plate P3, the function can be very easily changed, so that the cost required for changing the function can greatly be reduced.

Figure 9:
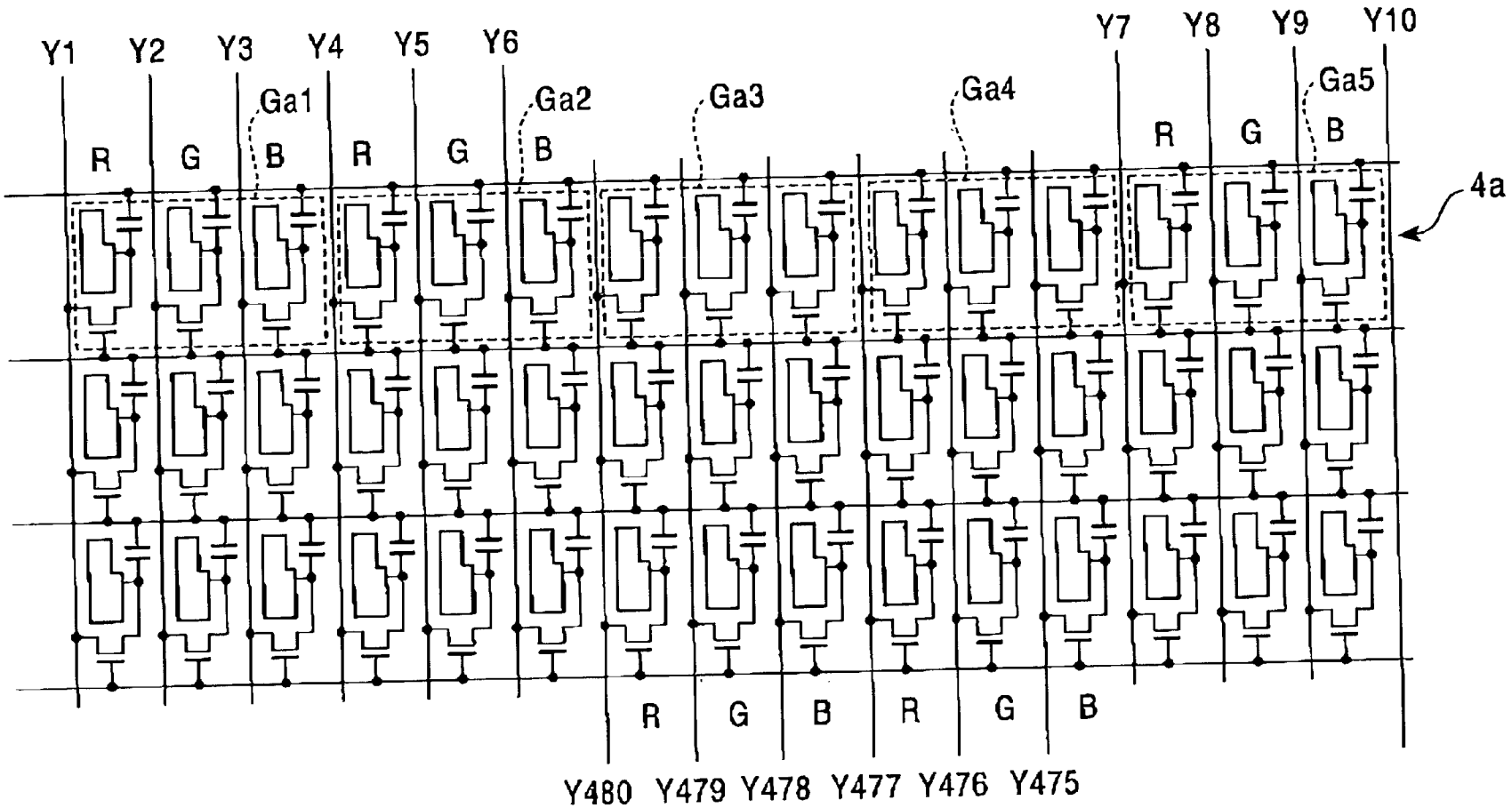
FIG. 9 is a circuit diagram showing the structure of the display screen 4*a* of a display device according to a fourth embodiment of the present invention.

FIG. 9 shows the structure of the display screen 4*a* of a display device according to a fourth embodiment of the present invention. The fourth embodiment comprises an arrangement in which data lines alternately lead to the upper and lower sides of the display screen 4*a* for each set of two pixels (six dots).

Figure 10:
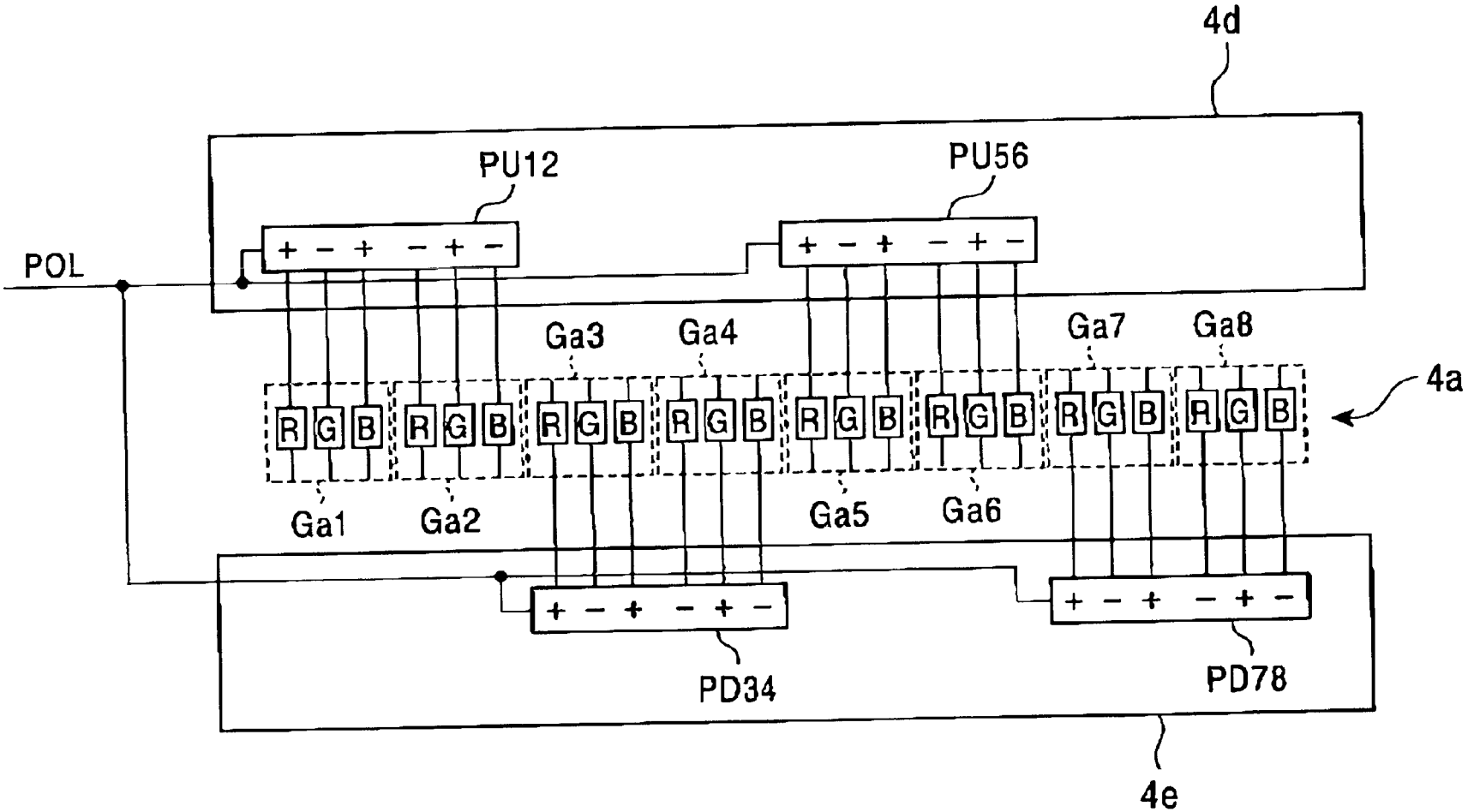
FIG. 10 is a block diagram showing the display device according to the fourth embodiment of the present invention.

As FIG. 10 shows, sets of six data lines are connected to an upper driving circuit 4*d* and a lower driving circuit 4*e*. Polarity control circuits PU12 and PU56 in the upper driving circuit 4*d*, and polarity control circuits PD34 and PD78 in the lower driving circuit 4*e* drive dots by using polarities in accordance with a common polarity control signal POL.

Specifically, when the polarity control signal POL is at a high level, each of the polarity control circuits PU12 and PU56 in the upper driving circuit 4*d*, and the polarity control circuits PD34 and PD78 in the lower driving circuit 4*e* drives the dots by using the polarities represented by (R, G, B, R, G, B)=(+, −, +, −, +, −). When the polarity control signal POL is at a low level, each of the polarity control circuits PU12 and PU56 in the upper driving circuit 4*d*, and the polarity control circuits PD34 and PD78 in the lower driving circuit 4*e* drives the dots by using the polarities represented by (R, G, B, R, G, B)=(−, +, −, +, −, +).

By way of example, if the polarity control signal POL is set at the high level on a certain line, by inverting the polarity control signal POL on the next line so as to be at the low level, and further inverting the polarity control signal POL again in the subsequent field or frame, dot inversion can be realized.

Figure 11:
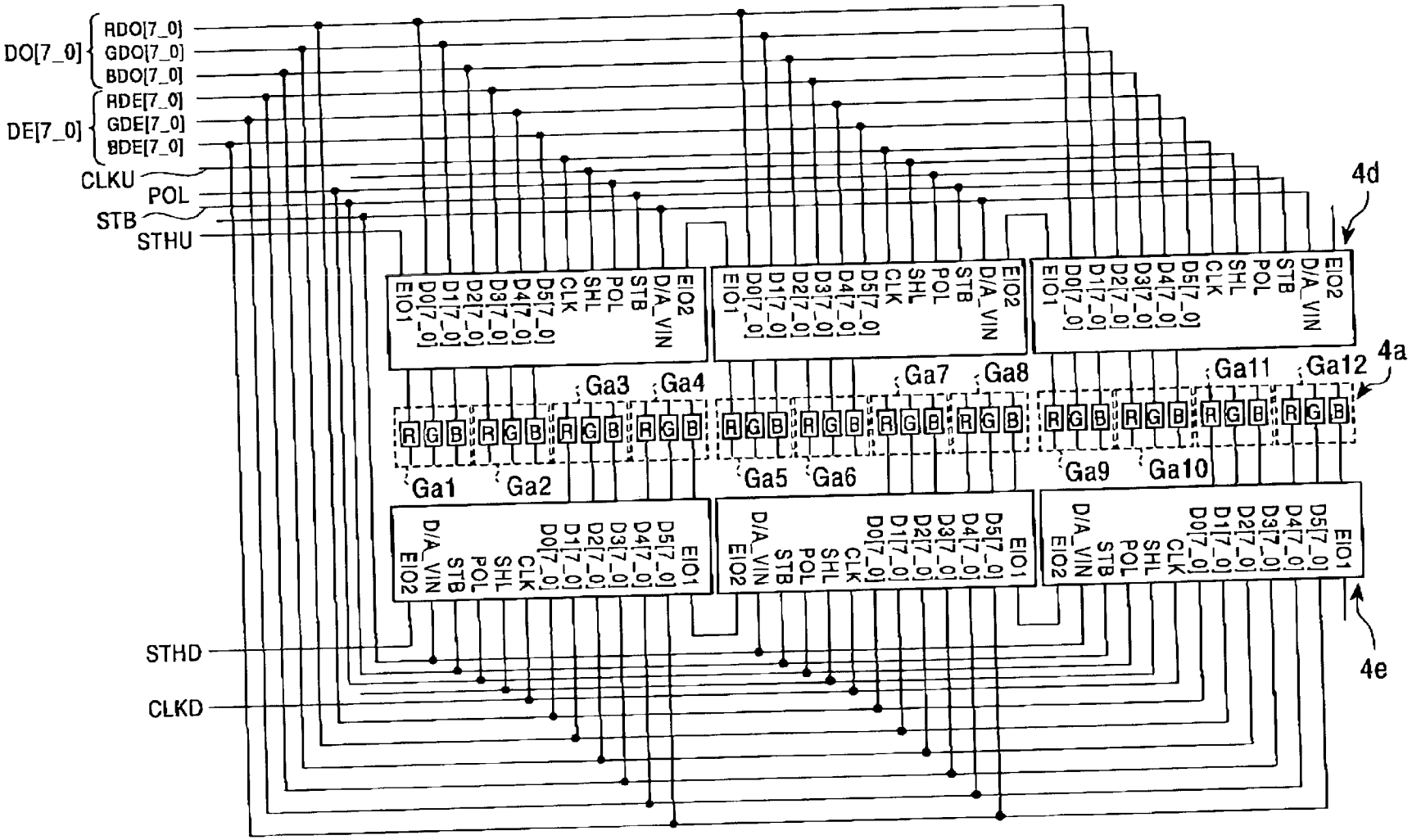
FIG. 11 is a detailed block diagram showing the display device according to the fourth embodiment of the present invention.

FIG. 11 is a detailed block diagram showing the display device according to the fourth embodiment. This display device includes the display screen 4*a*, the upper driving circuits 4*d*, and the lower driving circuits 4*e*. In the display screen 4*a* shown in FIG. 11, the pixels Ga1, Ga2, Ga3, etc., for one line, and data lines connected to dots constituting these pixels are only shown, and the others are omitted. The other pixels and lines are omitted from the illustration for clarity purposes.

The upper driving circuits 4*d* and the lower driving circuits 4*e* in the fourth embodiment are so-called "two-port-input driving circuits" that, with one clock, simultaneously capture six types of input data, RDO, GDO, BDO, RDE, GDE, and BDE. Clocks CLKU, a start pulse STHU, and the polarity control signal POU are input to each upper driving circuit 4*d*, and clocks CLKD, a start pulse STHD, and the polarity control signal POL are input to each lower driving circuit 4*e*.

Figure 12:
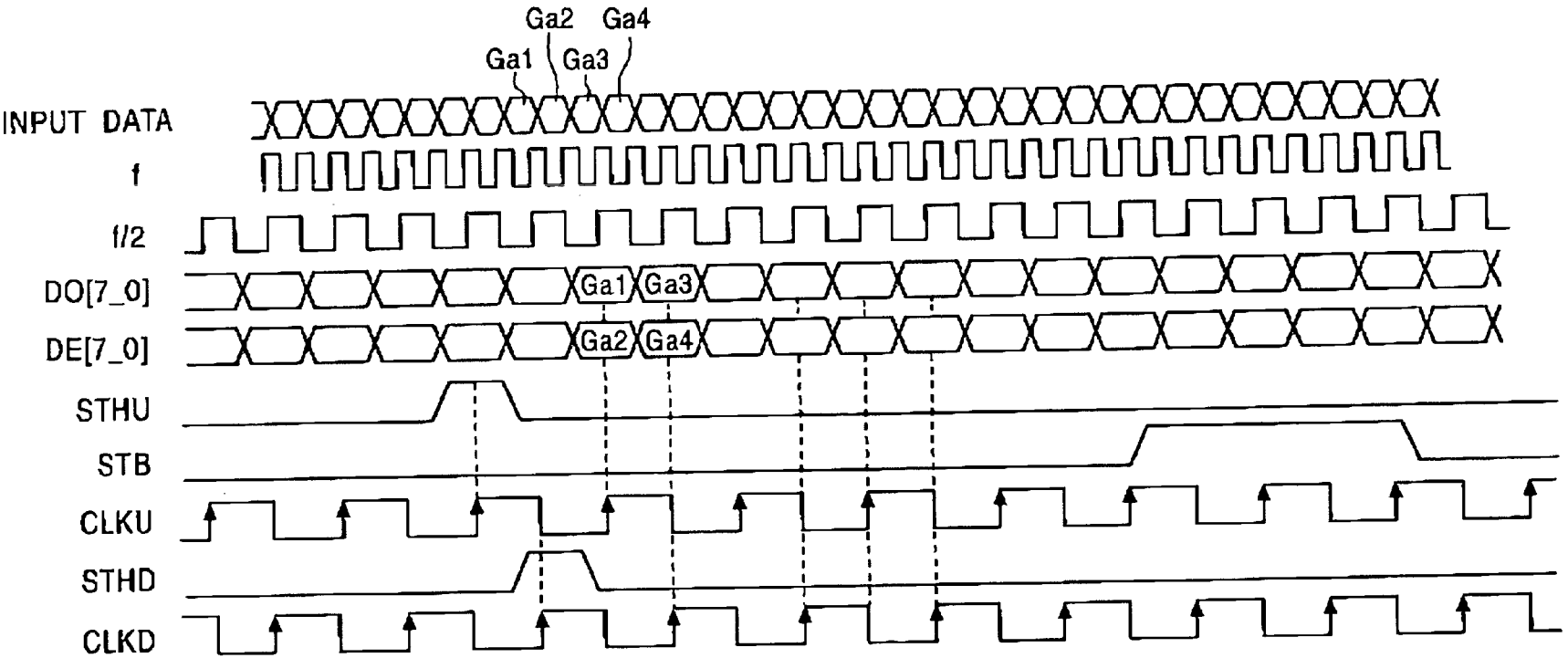
FIG. 12 is a timing chart showing the operation of the display device according to the fourth embodiment of the present invention.

FIG. 12 is a timing chart showing the operation of the display device according to the fourth embodiment. Input data are supplied to a parallelizing circuit (not shown) with timing synchronized with dot clocks f, and the parallelizing circuit outputs parallelized input data DO and DE. DO is a generic name for RDO, GDO, and BDO, and DE is a generic name for RDE, GDE, and BDE. DO and DE are input to both the lower driving circuits 4*d* and the lower driving circuits 4*e*.

The clocks CLKU supplied to the upper driving circuit 4*d* are such that the dot clocks DCLK are frequency-divided, and the clocks CLKD supplied to the lower driving circuits 4*e* are such that the clocks CLKU supplied to the upper driving circuits 4*d* are inverted. For example, preferably the clock frequency of clock CLKU is twice that of clock DCLK.

When the start pulse STHU is received by the upper driving circuits 4*d* in synchronization with a rise of the clocks CLKU, the upper driving circuits 4*d* synchronize with the rise of the clocks CLKU that follow the start pulse STHU, and capture the parallelized input data DO and DE.

The start pulse STHD is received by the lower driving circuits 4*e* in synchronization with a rise of the clocks CLKD that are delayed for a half period from the clocks CLKU. Then, the lower driving circuits 4*e* synchronize with the rise of the clocks CLKD that follow the start pulse STHD, and capture the parallelized input data DO and DE.

In other words, the same, parallelized data DO and DE are input to the upper driving circuits 4*d* and the lower driving circuits 4*e*. The upper driving circuits 4*d* capture the input data DO and DE at the rise of the clocks CLKU, while the lower driving circuits 4*e* capture the input data DO and DE at the fall of the clocks CLKU. Accordingly, the parallelized, input data DO and DE are alternately captured by the upper driving circuits 4*d* and the lower driving circuits 4*e*, and are displayed by pixels in correct positions.

In the fourth embodiment, a structure has been described in which the data lines alternately lead to the upper and lower sides of the display screen 4*a* for each set of two pixels (six dots) so as to be connected to the upper driving circuits 4*d* and the lower driving circuits 4*e*. However, the example is illustrative and not intended to be limiting. For example, the data lines may lead for each set of four pixels or for each set of six pixels and so on. In general, each set of an even number of pixels can be used without departing form the scope or spirit of the embodiments of the present invention.

Figure 13:
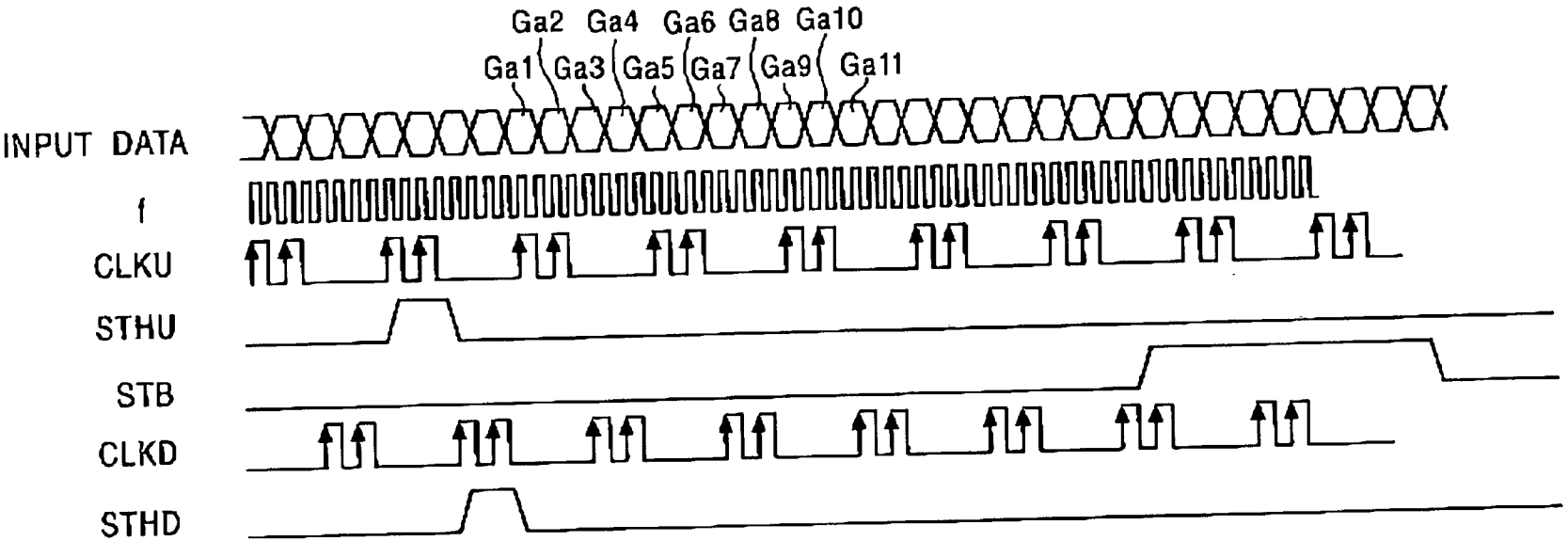
FIG. 13 is a timing chart showing control waveforms supplied to a driving circuit.

Moreover, the present invention is not limited to an arrangement in which the upper driving circuits 4*a* and the lower driving circuits 4*b* are so-called "two-port-input driving circuits" that simultaneously capture data from six bus lines in accordance with one clock. For example, when the data lines alternately lead to the upper and lower sides of the display screen 4*a* for each set of two pixels, by using a single-port driving circuit that is a so-called "general-type dot-inversion driving circuit", and supplying the driving circuit with the control waveforms shown in FIG. 13 in a circuit arrangement identical to that shown in FIG. 6, results similar to those in the fourth embodiment can be obtained.

Figure 14:
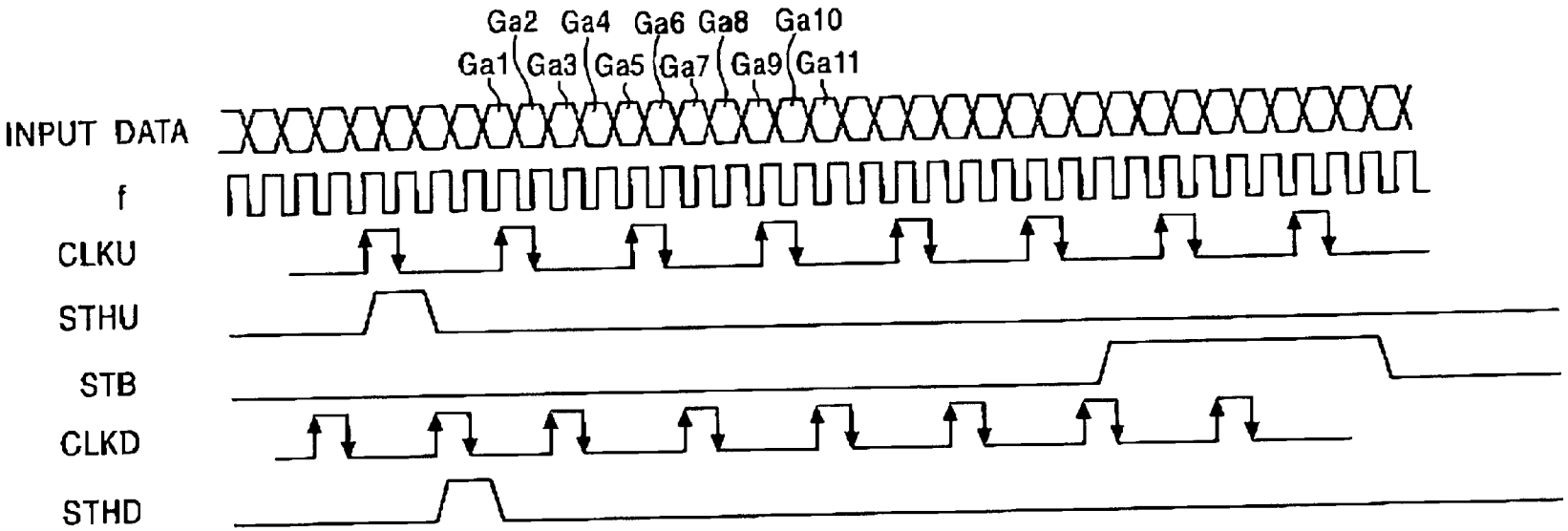
FIG. 14 is a timing chart showing control waveforms supplied to a driving circuit.
Figure 15A:
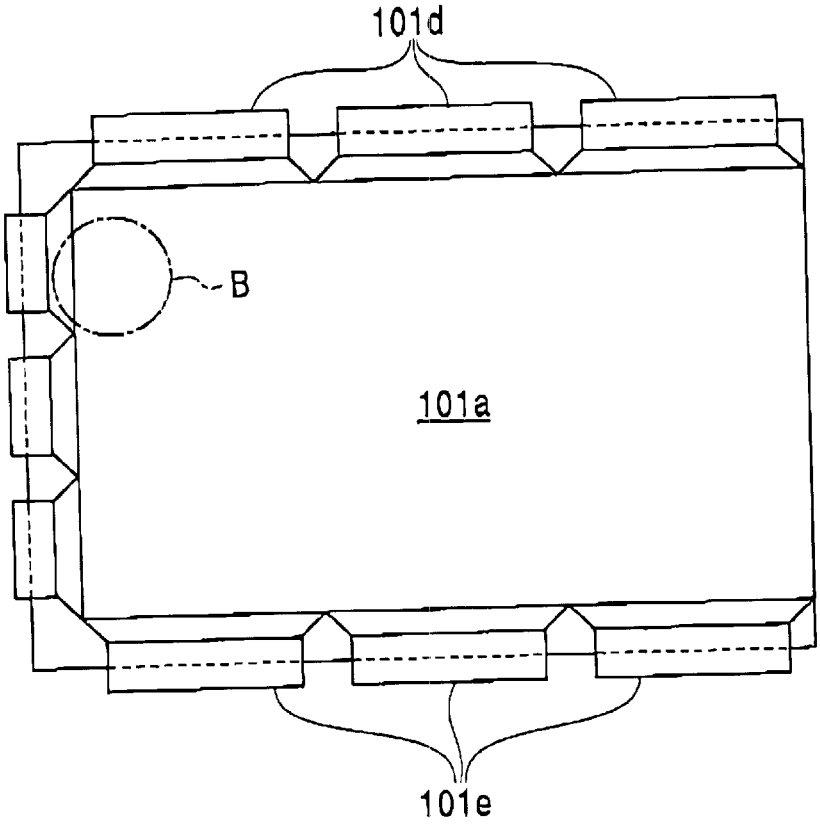
FIGS. 15A and 15B are illustrations of a liquid crystal panel (display device)
Figure 15B:
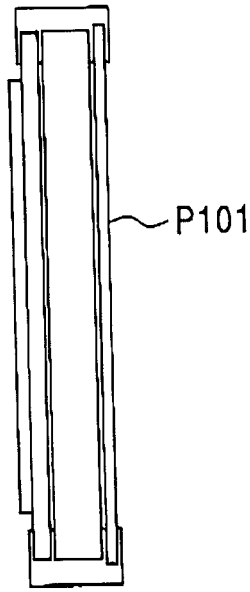
Figure 16:
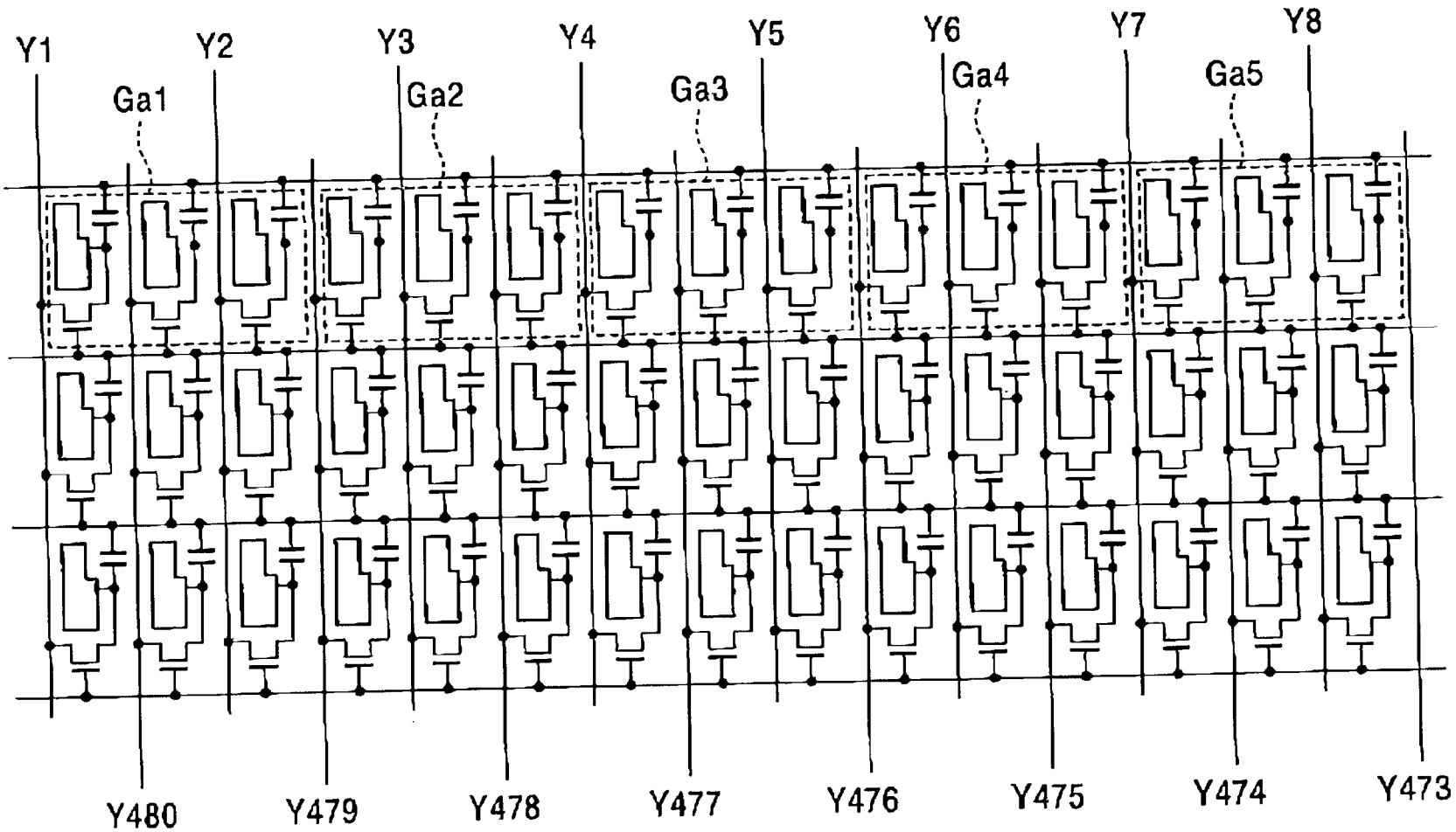
FIG. 16 is a block diagram in which portion B of the display screen 101*a* in FIG. 15 is shown enlarged.
Figure 17:
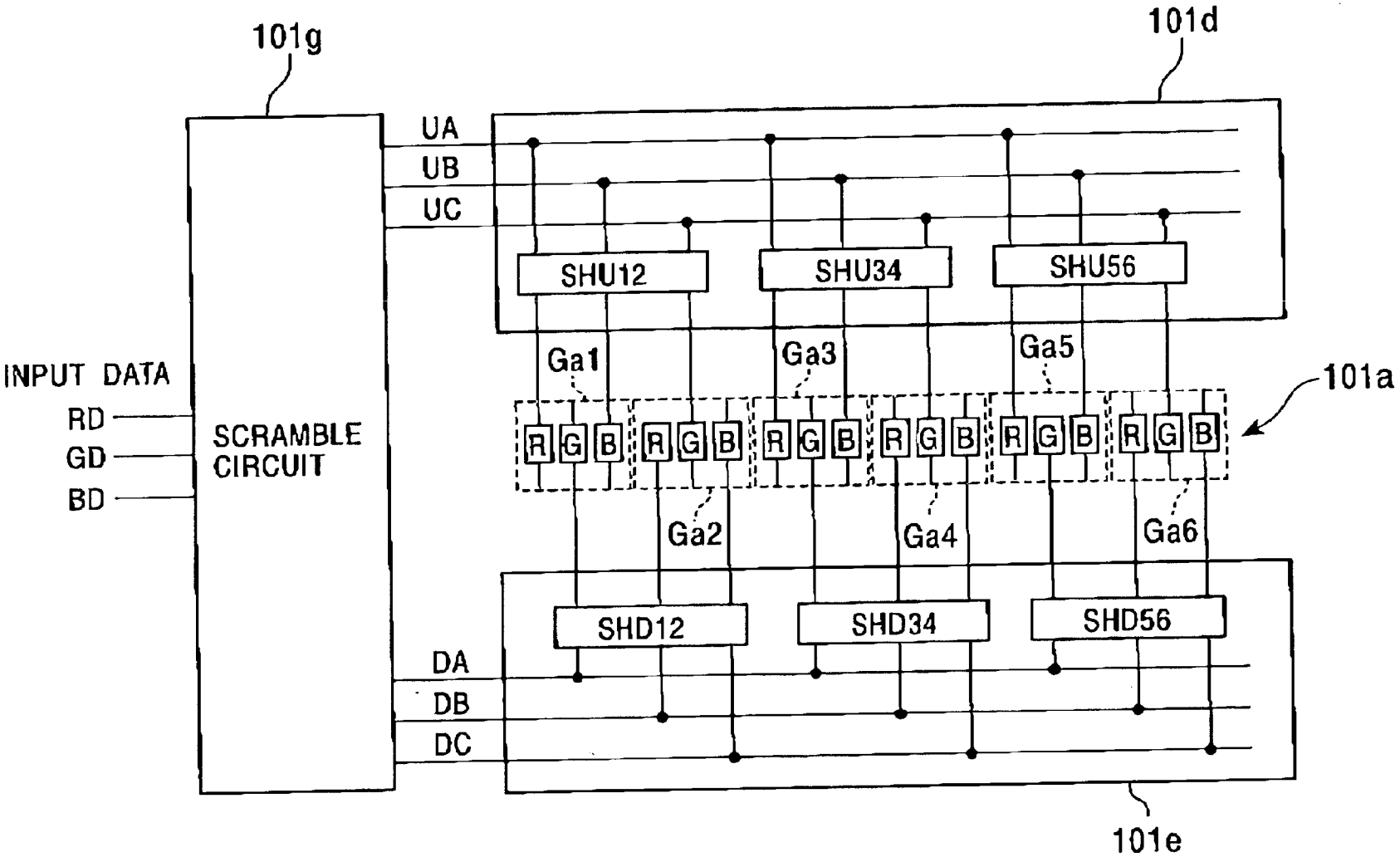
FIG. 17 is a detailed block diagram showing a display device of the related art.
Figure 18:
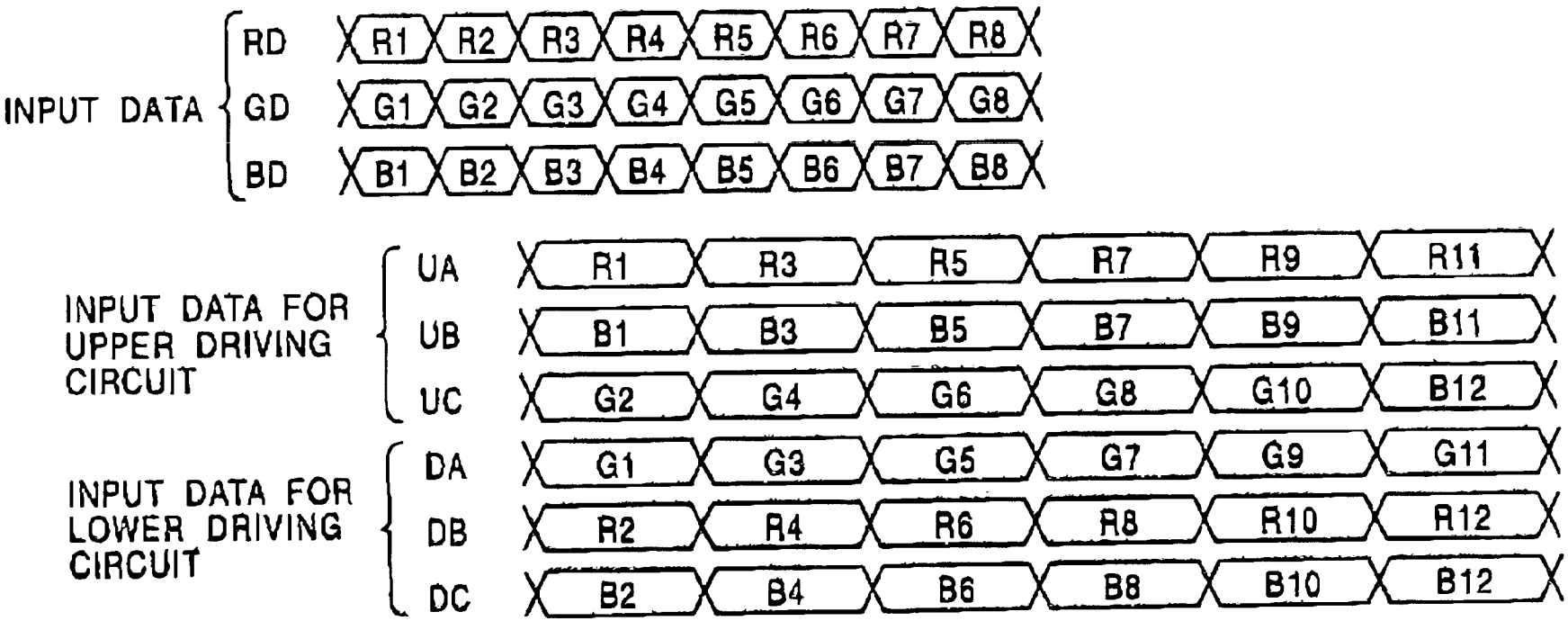
FIG. 18 is a timing chart showing a relationship between data received by a scramble circuit 101*g*, and display data transmitted from the scramble circuit 101*g*.

Also, by using a type of driving circuit that can capture the input data on two edges, that is, the rise and fall of a clock, and supplying the type of driving circuit with the control waveforms shown in FIG. 14, results similar to those in the fourth embodiment can be obtained.

What is claimed is:

1. A display device including a pair of substrates, with electrooptical material provided therebetween, a plurality of data lines and a plurality of scanning lines on a first substrate of said pair of substrates, and driving circuits provided on two sides on one of the substrates for driving said plurality of data lines, said plurality of data lines and said plurality of scanning lines crossing in the form of a matrix, said plurality of data lines including a first group of data lines leading to a first side on said first substrate, and said plurality of data lines including a second group of data lines which is other than said first group of data lines and which leads to a second side positioned so as to oppose said first side of said first substrate, said display device comprising a display screen in which the surface of said first substrate is divided into a plurality of dots by said plurality of data lines and said plurality of scanning lines and each set of three adjacent dots constitutes one pixel, wherein all data lines which are connected to said three adjacent dots constituting one pixel in said display screen lead to a single side among the sides of said first substrate, and are connected to a single side among said driving circuits.

2. A display device according to claim 1, wherein a plurality of pixels arranged along the scanning lines on said first substrate constituting said display screen are classified for each set of an odd number of pixels into a first group and a second group in the arranged order, said first group of data lines are connected to dots constituting said first group of pixels, and said second group of data lines are connected to dots constituting said second group of pixels.

3. A display device according to claim 1, wherein a plurality of pixels arranged along the scanning lines on said first substrate constituting said display screen are classified for each set of an even number of pixels into a first group and a second group in the arranged order, said first group of data lines are connected to dots constituting said first group of pixels, and said second group of data lines are connected to dots constituting said second group of pixels.

4. A display device according to claim 1, further comprising:

a first driving circuit which supplies said first group of data lines with driving signals for driving the dots; and a second driving circuit which supplies said second group of data lines with driving signals for driving the dots;

wherein input data are supplied to said first driving circuit and said second driving circuit through common lines.

5. A display device including a pair of substrates, with electrooptical material provided therebetween, and a plurality of data lines and a plurality of scanning lines on a first substrate of said pair of substrates, said plurality of data lines and said plurality of scanning lines crossing in the form of a matrix, said plurality of data lines including a first group of data lines leading to a first side on said first substrate, and said plurality of data lines including a second group of data lines which is other than said first group of data lines and which leads to a second side positioned so as to oppose said first side of said first substrate, said display device comprising:

a display screen in which the surface of said first substrate is divided into a plurality of dots by said plurality of data lines and said plurality of scanning lines and each set of a predetermined number of adjacent dots constitutes one pixel;

a first driving circuit which supplies said first group of data lines with driving signals for driving the dots; and a second driving circuit which supplies said second group of data lines with driving signals for driving the dots;

wherein a plurality of pixels arranged along the scanning lines on said first substrate constituting said display screen are classified for each set of an odd number of pixels into a first group and a second group in the arranged order, said first group of data lines are connected to dots constituting said first group of pixels, and said second group of data lines are connected to dots constituting said second group of pixels;

all data lines which are connected to said predetermined number of adjacent dots constituting one pixel in said display screen lead to a single side among the sides of said first substrate;

said first driving circuit supplies said first group of data lines with driving signals having polarities inverted between two adjacent data lines; and said second driving signal supplies said second group of data lines with driving signals which have polarities inverted between two adjacent data lines and which have inverse polarities compared with the driving signals supplied to said first group of data lines.

6. A display device including a pair of substrates, with electrooptical material provided therebetween, and a plurality of data lines and a plurality of scanning lines on a first substrate of said pair of substrates, said plurality of data lines and said plurality of scanning lines crossing in the form of a matrix, said plurality of data lines including a first group of data lines leading to a first side on said first substrate, and said plurality of data lines including a second group of data lines which is other than said first group of data lines and which leads to a second side positioned so as to oppose said first side of said first substrate, said display device comprising:

a display screen in which the surface of said first substrate is divided into a plurality of dots by said plurality of data lines and said plurality of scanning lines and each set of a predetermined number of adjacent dots constitutes one pixel;

a first driving circuit which supplies said first group of data lines with driving signals for driving the dots; and a second driving circuit which supplies said second group of data lines with driving signals for driving the dots;

wherein a plurality of pixels arranged along the scanning lines on said first substrate constituting said display screen are classified for each set of an even number of pixels into a first group and a second group in the arranged order, said first group of data lines are connected to dots constituting said first group of pixels, and said second group of data lines are connected to dots constituting said second group of pixels;

all data lines which are connected to said predetermined number of adjacent dots constituting one pixel in said display screen lead to a single side among the sides of said first substrate;

said first driving circuit supplies said first group of data lines with driving signals having polarities inverted between two adjacent data lines; and said second driving signal supplies said second group of data lines with driving signals which have polarities inverted between two adjacent data lines and which have identical polarities compared with the driving signals supplied to said first group of data lines.

7. A display device for displaying an image, the display device comprising:

at least one substrate having a plurality of scanning lines and a plurality of data lines crossing to form a matrix of dots, wherein a predetermined number of adjacent dots along a scan line form a pixel, the matrix of dots forms a matrix of pixels, and the plurality of data lines includes a first group and a second group;

a first driving circuit for driving signals along the first group of the plurality of data lines for driving selected dots; and a second driving circuit for driving signals along the second group of the plurality of data lines for driving selected dots, wherein the first driving circuit drives a (2n−1)th pixel, and the second driving circuit drives a (2n)th pixel, where n is a natural number, and wherein the first and second driving circuits are positioned to oppose with each other at two opposing sides of the substrate.

8. The display device of claim 7, wherein the plurality of data lines corresponding to adjacent dots within the pixel are driven in opposite polarities.

9. A display device for displaying an image, the display device comprising:

at least one substrate having a plurality of scanning lines and a plurality of data lines crossing to form a matrix of dots, wherein a predetermined number of adjacent dots along a scan line form a pixel, the matrix of dots forms a matrix of pixels, and the plurality of data lines includes a first group and a second group;

a first driving circuit for driving signals along the first group of the plurality of data lines for driving selected dots; and a second driving circuit for driving signals along the second group of the plurality of data lines for driving selected dots, wherein the first driving circuit drives a (4n−3)th pixel, and a (4n−2)th pixel, and the second driving circuit drives a (4n−1)th pixel, and a (4n)th pixel, where n is a natural number, and wherein the first and second driving circuits are positioned to oppose with each other at two opposing sides of the substrate.

10. The display device of claim 9, wherein the plurality of data lines corresponding to adjacent dots within the (4n−3)th pixel, and the (4n−2)th pixel are driven in opposite polarities, and the plurality of data lines corresponding to adjacent dots within the (4n−1)th pixel, and the (4n)th pixel are driven in opposite polarities.

* * * * *